US007718936B2

(12) United States Patent
Falabella et al.

(10) Patent No.: US 7,718,936 B2
(45) Date of Patent: May 18, 2010

(54) BULK MATERIAL WINDOWS FOR DISTRIBUTED APERTURE SENSORS

(75) Inventors: David Falabella, Merritt Island, FL (US); James Juliano, Orlando, FL (US); Walter B. May, Orlando, FL (US); Valerie Potthoff, Windermere, FL (US); Kevin F. Williams, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 171 days.

(21) Appl. No.: 10/861,005

(22) Filed: Jun. 3, 2004

(65) Prior Publication Data

US 2005/0270230 A1 Dec. 8, 2005

(51) Int. Cl.

| | |
|---|---|
| ***F42B 15/34*** | (2006.01) |
| ***F41G 7/20*** | (2006.01) |
| ***F41G 7/26*** | (2006.01) |
| *F42B 15/00* | (2006.01) |
| *F41G 7/00* | (2006.01) |

(52) U.S. Cl. ..... 244/3.1; 244/3.15; 244/3.16

(58) Field of Classification Search ..... 49/209; 244/3.1–3.3; 343/872, 873, 700 MS; 342/27, 342/28, 59, 70, 165, 175; 438/106, 107
See application file for complete search history.

(56) References Cited

U.S. PATENT DOCUMENTS

| | | | | | |
|---|---|---|---|---|---|
| 562,935 | A | * | 6/1896 | Sweet | 49/209 |
| 3,912,859 | A | * | 10/1975 | Christopherson | 244/3.16 |
| 3,944,167 | A | * | 3/1976 | Figler et al. | 244/3.16 |
| 4,006,356 | A | * | 2/1977 | Johnson et al. | 244/3.16 |
| 4,231,533 | A | * | 11/1980 | Durig | 244/3.16 |
| 4,245,890 | A | * | 1/1981 | Hartman et al. | 244/3.16 |
| 4,917,330 | A | * | 4/1990 | Dulat et al. | 244/3.16 |

(Continued)

FOREIGN PATENT DOCUMENTS

WO WO-02/101774 12/2002

OTHER PUBLICATIONS

E. Gaten, "Optics and phylogeny: is there an insight? The evolution of superposition eyes in the Decapoda (Crustacea)"; "Contributions to Zoology," vol. 67, issue 4, pp. 223-236, 1998; posted on Internet at dpc.uba.uva.nl/ctz/vol67/nr04/art01.*

(Continued)

*Primary Examiner*—Bernarr E Gregory
(74) *Attorney, Agent, or Firm*—Jeffrey D. Myers; Peacock Myers, P.C.; Timothy D. Stanley

(57) ABSTRACT

A distributed aperture sensor system and sensing method comprising a plurality of sensors each having an aperture and window that provides electromagnetic interference shielding by a material with a bulk resistivity of less than or approximately equal to 10 ohm-cm that is substantially uniform throughout the window.

18 Claims, 3 Drawing Sheets

U.S. PATENT DOCUMENTS

| | | | | | |
|---|---|---|---|---|---|
| 5,075,797 | A | * | 12/1991 | Jones | 244/3.16 |
| 5,259,570 | A | * | 11/1993 | Sochard | 244/3.16 |
| 5,639,683 | A | * | 6/1997 | Reyes | 438/107 |
| 5,647,560 | A | * | 7/1997 | Schnatz et al. | 244/3.15 |
| 5,681,009 | A | * | 10/1997 | Vandersteen et al. | 244/3.16 |
| 5,693,907 | A | * | 12/1997 | Rudnik | 244/3.16 |
| 6,842,144 | B2 | * | 1/2005 | Guo et al. | 343/700 MS |
| 6,946,642 | B2 | * | 9/2005 | Mangoubi | 244/3.16 |

OTHER PUBLICATIONS

R. Volkel et al., "Miniaturized imaging systems"; "Microelectronic Engineering," 67-68 (2003) 461-472; on Internet at elsevier.com/locate/mee.*

"The Compound Eye"; no author given; dated Dec. 8, 2004; on Internet at users.rcn.com/jkimball.ma.ultranet/BiologyPages/C/CompoundEye.html.*

M. Ackermann et al., "Search for extraterrestrial point sources of high energy neutrinos with AMANDA-II using data collected in 2000-2003"; Phys. Rev. D71 (2005) 077102; on the Internet at arXiv:astro-ph/0412347 v1; dated Dec. 14, 2004.*

"Photomultiplier Handbook"; no author listed; posted on the Internet at www.burle.com; printed in Oct. 1989.*

"Conductivity"; entry in the Microwave Encyclopedia; posted on the Internet at microwaves101.com; dated Jan. 31, 2006.*

* cited by examiner

BULK MATERIAL WINDOWS FOR DISTRIBUTED APERTURE SENSORS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to windows for distributed aperture sensors.

2. Description of Related Art

Distributed aperture sensors comprise a collection of sensors mounted either around a vehicle or co-located in one location where an unobstructed 360 degree line-of-sight (or other field of view requiring more than one sensor aperture) can be obtained. Each aperture will ordinarily comprise a window.

The electromagnetic (EM) capabilities of different window materials and resistivities play an important role in the EM compatibility of host vehicles and the performance of on-board sensors. In the mid-wave infrared, there is a trade between high and low bulk resistivity silicon (Si) windows. The former provides high transmission for optimal sensor performance, while the latter provides increased conductance for low radar cross sections (RCS). In the past, a relatively expensive compromise was utilized to provide the benefits of both types of materials by overlaying the bulk Si substrate material with a low resistivity epitaxial layer. These materials represented a major cost and schedule impact due to the number of steps and amount of material processing, the high degree of precision and the tolerances that had to be maintained, and the requirement for special handling and tools necessary for producing the finished product.

Recent advances in materials processing, however, have made available materials that can be better tuned for bulk resistivity. These bulk materials are readily available and can be readily provided at a substantially lower cost.

The present invention recognized that these bulk materials exhibit performance properties that make them candidates for a lower cost replacement for the epitaxial layer equipped window substrates for distributed aperture sensor windows. Results indicate that a simple, scaleable, readily available, cost and performance effective alternative exists to the traditional expensive, complex, multi-layer applications currently implemented.

BRIEF SUMMARY OF THE INVENTION

The present invention is of a sensor system and method comprising: employing a window comprising a material with a bulk resistivity that is substantially uniform throughout the window; and sensing electromagnetic radiation through the window. In the preferred embodiment, the window consists substantially of the material, and most preferably consists of the material. The window preferably lacks an epitaxial layer and is a component of a distributed aperture sensor system or radar system. The bulk resistivity is preferably less than or equal to approximately 10 ohm-cm, more preferably less than or equal to approximately 5 ohm-cm, and most preferably wherein the window is approximately 0.25" thick. The material preferably comprises silicon.

The present invention is also of a window for a sensor system comprising a material with a bulk resistivity that is substantially uniform throughout the window.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a window for a distributed aperture sensor (or single aperture sensor, though this is less preferred) comprising a material with a bulk resistivity that is substantially uniform throughout the window. The preferred material is silicon, and the preferred bulk resistivity is less than 10 ohm-cm, most preferably less than 5 ohm-cm (particularly for a silicon window of 0.25" thickness). Preferably the window consists substantially of such material, and most preferably the window consists of such material. The invention is also of a corresponding method and sensor system.

Figure 1:
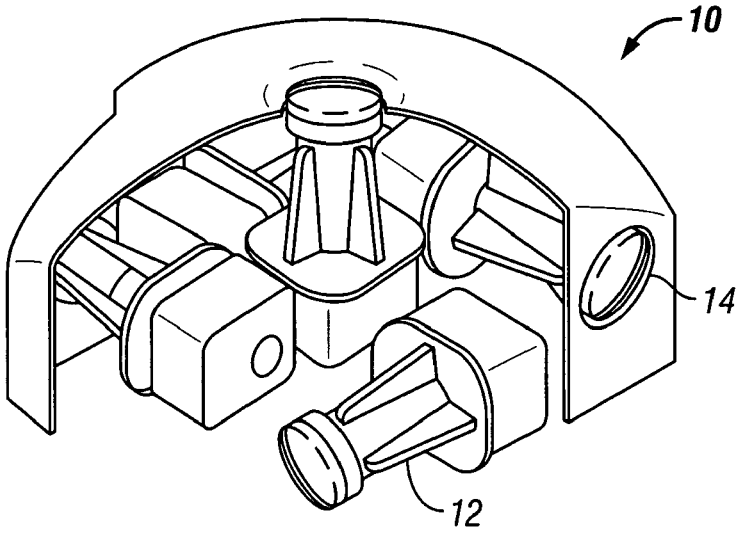
FIG. 1 is a cut-away view of a distributed aperture sensor system comprising windows according to the invention.

As shown in FIG. 1, a preferred distributed aperture sensor system 10 according to the invention comprises a plurality of sensors 12 each with a window 14 of the invention.

INDUSTRIAL APPLICABILITY

The invention is further illustrated by the following non-limiting examples.

EXAMPLE 1

Two sample window substrates consisting of various characteristic and substantially uniform bulk resistivities were compared to a known measured baseline substrate equipped with a high conductivity epitaxial overlay. The sample substrates were manufactured to the same shape and tolerances as a baseline windowpane. All the items were then subsequently mounted in the same test fixture for measurement purposes. Radar cross-section and insertion loss measurements were then performed under identical conditions. The radar cross section testing of the silicon window substrates compared the backscatter produced at the window/frame interface to a typical production-type configuration window with an epitaxial (Epi) layer on its top surface. The main area of interest for this test was the backscatter produced by the window/frame interface at near grazing incidence angles. IR spectral transmission measurements were also performed on each of the substrates to determine the relative impact of bulk loading on transmission.

Results of the RCS characterization measurements indicate that there is a range of bulk volume resistivities within which the RCS performance closely matches that of the substrate containing the high conductivity epitaxial layer. Measurements of insertion loss for each of the substrates demonstrated consistent and similar performance characteristics. Results of the IR transmission measurements indicate nearly identical transmission performance for each of the substrates.

To evaluate the near grazing incidence backscatter produced by the Si window/Al frame interface, a very low RCS at grazing incidence test fixture was chosen. This test body, a 6 ft. model, features a top, center mounted, diamond shaped test coupon panel into which is inserted the window under test. The RCS tests were conducted using a 20-foot tall, low RCS pylon/Az over El rotator system. A range of 45 feet exists between the radar antennas and the pylon/rotator location. The rotator provides 360.0 degrees of azimuth rotation at elevation angles of interest.

Figure 2:
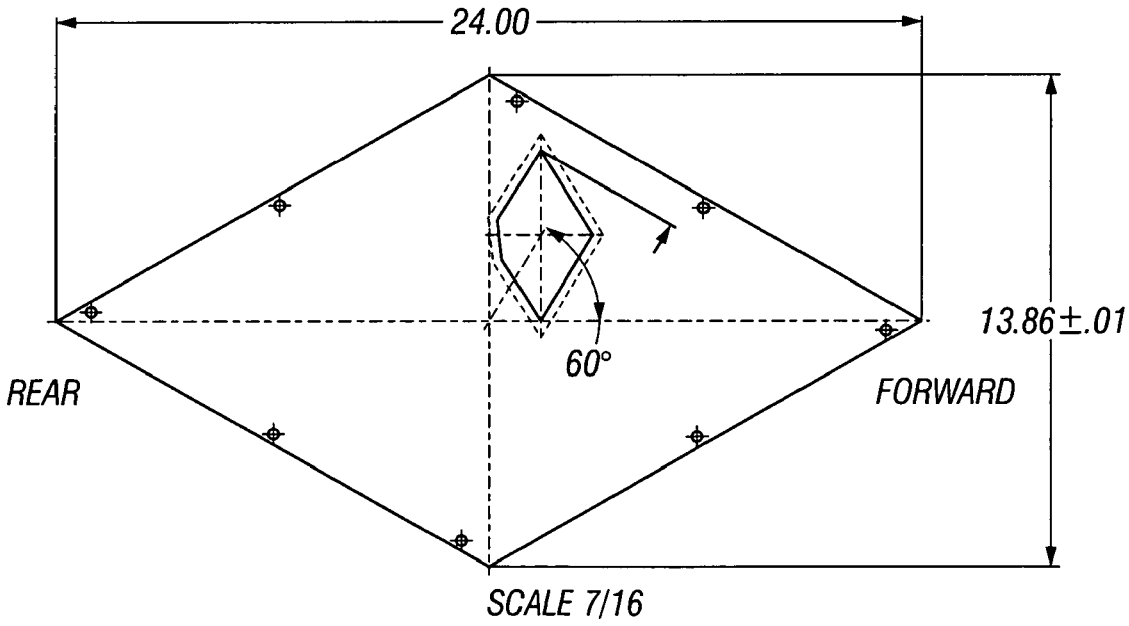
FIG. 2 is a diagram of the test coupon panel with window bezel of the example.

The window substrate chosen to serve as the baseline for this evaluation has 2.75" long, straight leading edges at angles of 29° and 31° relative to the window's long axis. A production configuration bezel was machined into a 0.25" thick, T6 aluminum, removable test coupon panel. It was located forward of the center of rotation and at an angle of 60° relative to the diamond's long axis radially outward from the center as far as possible to enhance movement of the window when the test body is rotated in azimuth. FIG. 2 provides a top view of the test coupon panel with the window and bezel placement. Note that at 0° azimuth, the window's longest edges are facing forward toward the RF emitter.

A 151 tap FIR Doppler filter was used to remove stationary scatterers, i.e. pylon, test body to pylon interactions, test chamber noise, etc., from the measured backscatter to reduce the background—which tends to be higher in VV polarization (transmitter and receiver vertically polarized). After the diamond test coupon panel was placed in the test body, its edges were taped with metallic tape and the tape was painted with a conductive copper paint similar to that used on the test body's surface.

The entire diamond test coupon panel was nickel plated on both sides to mimic a window frame and all three windows were test fitted into the bezel and profiled to insure that they met a step requirement of +5/−4 mils. The average step height for the three windows as tested were:

Production Baseline: −2.2 mils;

10 ohm-cm window: −2.7 mils; and 2 ohm-cm window: +0.6 mils.

The RCS tests were conducted using the parameters in Table 1. The range gate was centered about the 6' test body's center of rotation.

TABLE 1

RCS Test Parameters

| Parameter | Specification |
|---|---|
| Frequency | |
| X band | 10 GHz |
| Ku band | 16 GHz |
| Polarization | HH |
| | VV |
| Range Gate | 1.22 meters (4 feet) |
| Pitch | 1°, +10°, +15° |
| Azimuth | |
| Continuous | −50° to +50° steps of 0.1° |

Note that the range gate was set at 4 feet to eliminate scattering from the test body's leading and trailing tips and that backscatter data was collected for grazing incidence angles of 1°, 10° and 15°.

The measurement system was calibrated for RCS data collection using a six (6) inch diameter metallic sphere (−17.4 $dB_{sm}$).

One baseline configuration was tested: a standard production configuration silicon window with Epi layer that met typical specifications for such windows. Backscatter from this window's interface region, window/Al knife edge, is the reference backscatter level for comparison with that produced by the two bulk silicon test windows. Two different resistivity windows according to the invention, 2 and 10 ohm-cm, were installed into the test coupon panel and the resulting backscatter was measured and compared to the baseline configuration to determine any increase in backscatter due to the use of the non-Epi layer windows.

All tests were conducted at ambient conditions of temperature, humidity, and pressure prevailing at the test facility at the time the testing was performed.

The following test equipment was used for this test. Equivalent test equipment could have been substituted if needed. Measurement test equipment was certified to be within calibration and of the required accuracy to fulfill the needs of these tests.

A. HP8510C Network Analyzer

B. RF Synthesized Sources: HP8341B and HP83622B

C. HP8517B Test Set

D. S, C and X through Ku band TWTA amplifiers

E. EM Systems A6100 Feedhorns, One for Transmit and One for Receive

F. IBM PC with Compu-Quest 1519 Collection and Analysis System V1.23 Software

Figure 3:
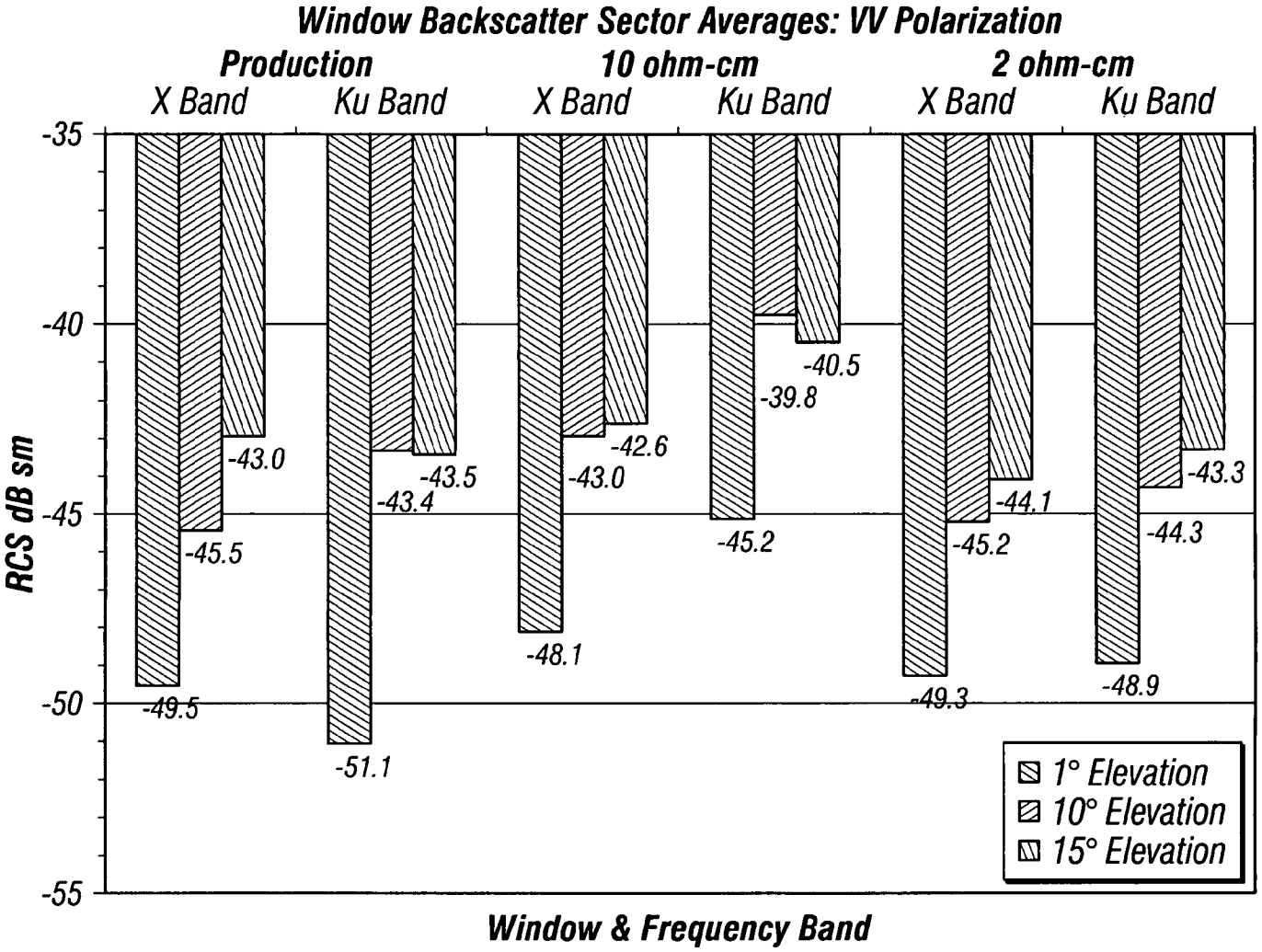
FIG. 3 is a chart comparing backscatter sector averages for prior art windows and windows according to the invention with 10 ohm-cm and 2 ohm-cm bulk resistivities.

No measurable backscatter was observed at the window location in HH polarization for all three windows and for all test configurations. In VV polarization, backscatter was observed and the downrange versus azimuth images were used to determine the location and width of the scattering produced by the window's leading edges. Arithmetic sector averages encompassing these two scattering centers were utilized to perform the backscatter comparison of the three windows. The right and left sectors were averaged independently, their average taken and then converted into $dB_{sm}$ to arrive at a single backscatter level at each elevation angle for the window. In X band, the window leading edge scattering occurs over a wider angular sector than in Ku band so, in X band, wider sectors were used for the averaging. FIG. 3 presents a summary of the W polarization, sector averaged backscatter data for the three windows in each frequency band and at each elevation angle. As can be seen, backscatter from all three windows is less than −43 $dB_{sm}$ except for the 10 ohm-cm window in Ku band at 10° and 15° elevation angles. Table 2 gives the elevation averaged, measured backscatter difference between the 10 and 2 ohm-cm windows and the production configuration window.

TABLE 2

| Backscatter Difference Between Simple Si Windows and Production Window | | |
|---|---|---|
| Test Window | X Band Backscatter Increase | Ku Band Backscatter Increase |
| 10 ohm-cm Silicon | 1.4 dBsm | 4.2 dBsm |
| 2 ohm-cm Silicon | 0.2 dBsm | 0.5 dBsm |

Figure 4:
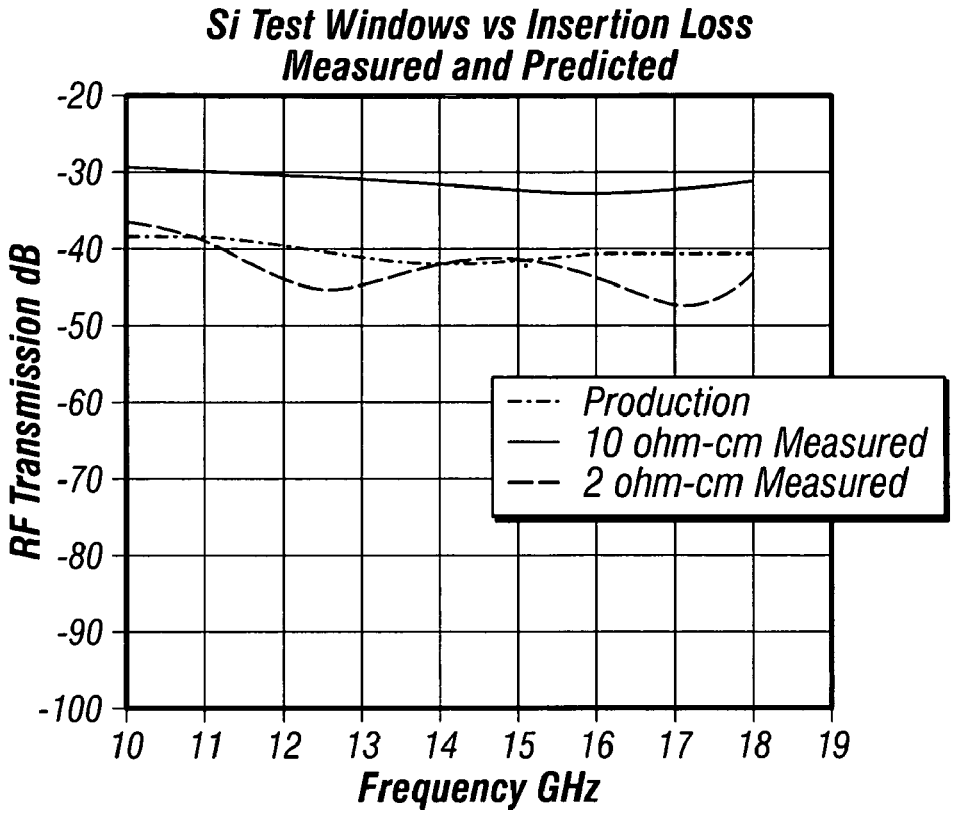
FIG. 4 is a graph comparing insertion loss in the windows of FIG. 3.

Before the window was removed from the test coupon panel, its RF insertion loss was measured in a transmission tunnel. Due to the window dimensions, this data is only valid from approximately 10 GHz and up. Also, since the windows were not potted into the bezel for this test but just metal taped around their perimeter on the underside of the diamond panel, more RF leakage occurred than would be expected in an actual window installation. FIG. 4 shows the measured RF transmission levels for both the 10 ohm-cm and 2 ohm-cm windows and the measured level for the production window.

Figure 5:
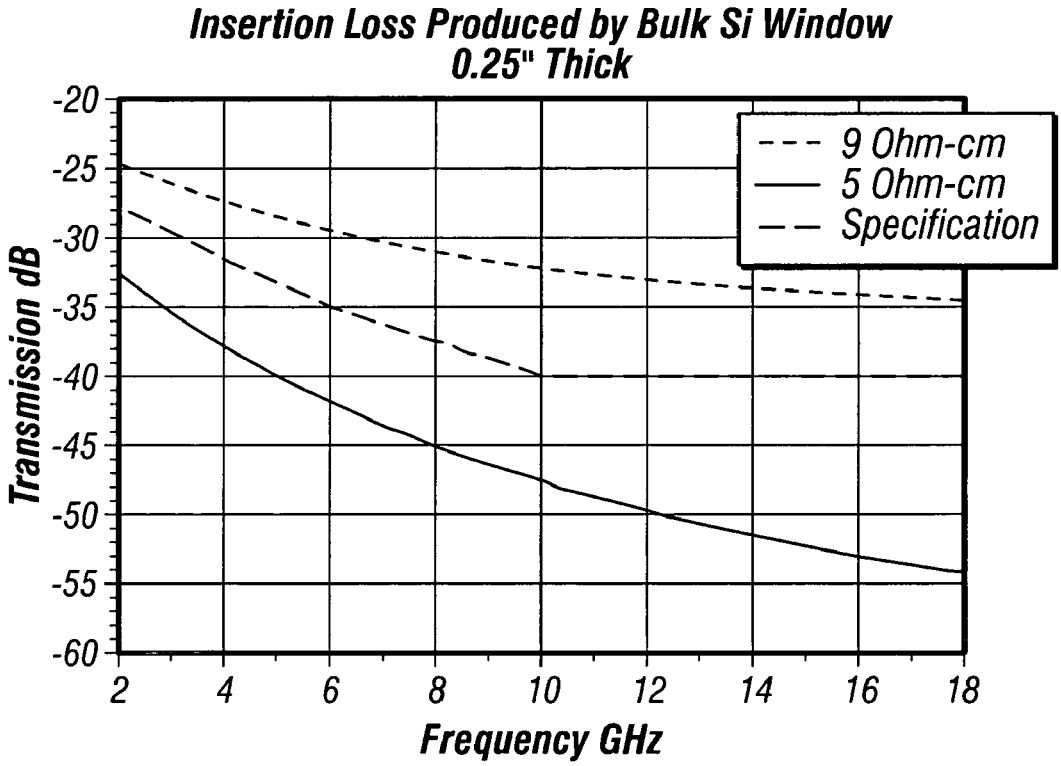
FIG. 5 is a graph comparing insertion loss in a 0.25" thick bulk silicon window at 9 ohm-cm and 5 ohm-cm compared to a preferred maximum.

Increase in backscatter over the production configuration window due to use of the 2 ohm-cm simple silicon window is insignificant and within measurement error. The RF insertion loss provided by the 2 ohm-cm window far exceeds current typical requirements. On the other hand, backscatter from the 10 ohm-cm window is 2 to 4 $dB_{sm}$ higher which may not be very significant in an actual detector installation. An Si window resistivity of 5 ohm-cm or less at a thickness of 0.250 inches +/−0.005 inches is preferred to provide adequate insertion loss as indicated in FIG. 5. This figure shows the insertion loss attainable by using the current typical allowable range for the silicon window's volume resistivity (5 to 9 ohm-cm) along with the insertion loss performance specification for the window. Accordingly, the present invention permits the elimination of the epitaxial layer and re-specification of silicon window substrates to have a bulk volume resistivity of 5 ohm-cm or less. Backscatter levels from a 5 ohm-cm simple silicon window were not evaluated during this test but based upon the levels observed from the 10 and 2 ohm-cm windows, backscatter produced by a 5 ohm-cm window should be acceptable.

The preceding example can be repeated with similar success by substituting the generically or specifically described reactants and/or operating conditions of this invention for those used in the preceding example.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A distributed aperture sensor system comprising:

a plurality of manufactured sensors, each having an aperture and each having a corresponding window that provides electromagnetic interference shielding by having a bulk resistivity less than or approximately equal to 10 ohm-cm which bulk resistivity is substantially uniform throughout.

2. The sensor system of claim 1 wherein each said window lacks an epitaxial layer.

3. The sensor system of claim 1 wherein each of said plurality of sensors is an electro optical sensor.

4. The sensor system of claim 1 wherein said bulk resistivity is less than or equal to approximately 5 ohm-cm.

5. The sensor system of claim 4 wherein each said window is approximately 0.25" thick.

6. The sensor system of claim 1 wherein each said window comprises silicon.

7. The sensor system of claim 1 wherein each of said plurality of sensors is an infrared sensor.

8. A sensing method comprising:

employing in a manufactured distributed aperture sensor system a plurality of windows that provide electromagnetic interference shielding by having a bulk resistivity of less than or approximately equal to 10 ohm-cm, which bulk resistivity is substantially uniform throughout each window; and sensing electromagnetic radiation through the windows with a plurality of corresponding sensors.

9. The method of claim 8 wherein each window lacks an epitaxial layer.

10. The method of claim 8 wherein the distributed aperture sensor system is an electro optical system.

11. The method of claim 8 wherein the bulk resistivity is less than or equal to approximately 5 ohm-cm.

12. The method of claim 11 wherein each window is approximately 0.25" thick.

13. The method of claim 8 wherein each window comprises silicon.

14. The method of claim 8 wherein in the employing step the distributed aperture sensor system is an infrared sensor system.

15. In a manufactured sensor system comprising a window which comprises electromagnetic shielding properties, the improvement comprising said window having electromagnetic shielding properties by having a bulk resistivity of less than or approximately equal to 10 ohm-cm which bulk resistivity is substantially uniform throughout said window.

16. The sensor system of claim 15 wherein in the bulk resistivity is less than or equal to approximately 5 ohm-cm.

17. The sensor system of claim 16 wherein said window is approximately 0.25" thick.

18. The sensor system of claim 15 wherein said window comprises silicon.

* * * * *